US008910929B2

(12) United States Patent
Walsh et al.

(10) Patent No.: US 8,910,929 B2
(45) Date of Patent: Dec. 16, 2014

(54) PRINTER ARCHITECTURE ENABLING NARROW OR WIDE FRONT FACING ORIENTATION

(71) Applicant: Xerox Corporation, Norwalk, CT (US)

(72) Inventors: Martin Scott Walsh, Portland, OR (US); Timothy Crawford, Saint Paul, OR (US); Mark H. Tennant, West Linn, OR (US); Aaron L. Boyce, Tigard, OR (US); Edward F. Burress, West Linn, OR (US); Isaac S. Frazier, Portland, OR (US); John E. Fanning, Portland, OR (US); Brent R. Jones, Sherwood, OR (US); Todd D. Smith, Portland, OR (US); Trevor J. Snyder, Newberg, OR (US); Carl T. Urban, Kirkland, WA (US); Paul Van Gasse, Tigard, OR (US); Paul Woodward, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/655,697

(22) Filed: Oct. 19, 2012

(65) Prior Publication Data

US 2014/0111911 A1 Apr. 24, 2014

(51) Int. Cl.
*B65H 3/44* (2006.01)

(52) U.S. Cl.
USPC ..... 271/9.11; 271/164; 399/107

(58) Field of Classification Search
CPC ..... B65H 2405/1134; B65H 2405/114; B65H 2405/113; B65H 2405/31; B65H 2405/332; B65H 2551/18; B65H 2551/21; H04N 1/00493; H04N 1/00496; H04N 1/00522; H04N 1/00538
USPC ..... 271/162, 164, 9.11; 399/107, 393, 124; 345/31
See application file for complete search history.

(56) References Cited

U.S. PATENT DOCUMENTS 6,824,129 B2 11/2004 Sides, II
7,245,854 B2 * 7/2007 Miyaji et al. ..... 399/124

FOREIGN PATENT DOCUMENTS

JP 2001305814 A * 11/2001 ..... G03G 15/00

OTHER PUBLICATIONS

Machine translation of JP 2001305814 A, retreived May 7, 2014.*

* cited by examiner

*Primary Examiner* — Michael McCullough
(74) *Attorney, Agent, or Firm* — Fay Sharpe LLP

(57) ABSTRACT

A printer architecture that enables a printer (or other media processing device) with an elongate foot print to be configured with media input and operator controls oriented at either a narrow end or a wide side thereof, that surface becoming the "front" of the unit. Controls and/or display(s) are mounted such that either the end or side orientation can be accommodated. The media input tray includes a separate assembly so that selection of the tray with access to end or side complements the user control panel in establishing the front of the machine. The combination of control/display mounting and oriented media tray structure integration with the print engine to establish which of the printer surfaces is considered the front allows for multiple orientations of the printer and greater flexibility to the customer.

15 Claims, 6 Drawing Sheets

PRINTER ARCHITECTURE ENABLING NARROW OR WIDE FRONT FACING ORIENTATION

BACKGROUND

Printers and related products, such as MFP's, have an architecture that defines the placement orientation of the unit relative to user access. For example, generally a printer is configured such that the most significant interactions, such as operation or setting selection via control panel or display and adding media to the input tray, faces what would be considered the front of the unit. Printers do not typically have a square footprint so the placement orientation, driven by primary user interfaces, determines which of the narrow or wide surfaces is the unit front. The aspect ratio is often an outcome of the paper path, its direction generally along the long axis. A narrow front with the paper path front to back, is often preferred for desks and limited table space. The wider orientation with a left-right paper path, is more flexible for auto document scanners and when equipping the unit with optional finishers (including, for example, sorting devices, collating devices, stapling devices, etc.) and high capacity input trays.

Most printers require access to multiple sides of the unit for maintenance, service and consumables replenishment, or other replaceable components that have limited life. The top and front surfaces are typically most important to satisfying user interfaces such as operation control and settings, retrieving printed output, replenishing input media and, for multi-function units, scanning and copying. Those primary interface requirements generally dictate how the product is placed on a desk or table, or how a standalone unit is oriented relative to typical access and user interaction space.

Solid ink printers often have a simplified paper path through the print engine. In most office size solid ink printers, media moves from the front to an output tray at the top-rear, as typically oriented. This front-back transport orientation may be termed North-South (N-S) and, in one exemplary embodiment, this also means media flow from one narrow end toward the other narrow end of an essentially rectangular product, regardless of viewing orientation. Rectangular product shape isn't a requirement of the present disclosure, however, and other product shapes are also possible. Standard media sizes are generally rectangular and functional areas of media trays and the typical A/A4 printing products are oriented so the short side is the leading edge in the feed path.

When such a printer is reconfigured as a multi-function printer (MFP), the copy scan module is routinely oriented left-right or East-West (E-W) for access purposes. When this module is placed above a N-S oriented print engine, the print engine is oriented with the narrow surface at the front while the copy module is oriented with the wide surface at the front. This results in a large projected footprint that is not ideal for stated orientation considerations.

A printer built with an E-W configuration matches the copy module orientation with common paper path flow direction and reduces the projected footprint but now requires placement in an E-W manner. The E-W printer configuration puts the wide side at the front and is not desk or space efficient in most applications. It should be appreciated that the depth of the unit is significantly less important on a desk since space behind the product is essentially unused. It has been found that transitioning the print engine design and resultant models from a N-S to E-W configuration has become desirable to emphasize MFP sales, but the orientation requirement is a compromise that has a negative effect on some customers, significantly, those that place a printer on a work station desk where width is limited.

Designing and building the described printer with an E-W architecture can be done by reconfiguring the enclosure, moving the controls and/or display panel and designing the paper tray to pull out from the wide side, now the front. This can be done while retaining the paper pick and transport system as it existed in the N-S product. A desirable feature of the E-W printer is complementary fitment with copy/scan modules and finishers. A drawback, however, is this new printer architecture generally forces an orientation that is incompatible with the narrow front many customers prefer, or are forced into for placement efficiency, on desks or limited space tables.

BRIEF DESCRIPTION

Printing products have not been produced with a basic engine that can be configured for either left-right or front-back placement orientation to best accommodate customer preferences. The present disclosure sets forth a printer architecture that enables a printer with a rectangular foot print to be configured with media input and operator controls oriented at either the narrow end or wide side, that surface becoming the "front" of the unit. Controls and/or display(s) are mounted such that either the end or side orientation can be accommodated. The media input tray is a separate assembly so that selection of the tray with access to end or side complements the user control panel in establishing the front of the machine. This disclosure includes the combination of control/display mounting and oriented media tray structure integration with the print engine to establish which of the printer surfaces is considered the front, allowing for multiple orientations of the printer and greater flexibility to the customer.

In accordance with one aspect, a media processing device comprises a main media processing unit having a housing with an elongate footprint, the housing having a relatively narrow first side adjacent a relatively wide second side, the housing including an interface port located adjacent the first and second sides, and an interface unit adapted to be received in the interface port in one of at least two orientations, a first orientation being aligned with the first side of the housing and a second orientation being aligned with a second side of the housing. When the interface unit is received in the interface port in the first orientation, the first side of the housing is the front of the paper processing device, and whereby when the interface unit is received in the interface port in the second orientation, the second side of the housing is the front of the paper processing device. In a similar but alternate configuration, the interface unit may be rotatable or have an articulation capability enabling both a primary direction selection and further angular adjustment enabling user orientation optimization. The interface unit or units may be mounted to an image input device, such as a scanner and/or auto document feeder with mounting location influenced by the configuration, for example, at the rear or near an alternate corner. A scan function may be provided in one or more ways, such as by a stationary or moving scan bar or camera. The image input device can be configured in many different forms.

The interface unit can include a display and/or a user input device. The housing can include a top side adjacent the first and second sides, and the interface port can be located on the top side of the housing. The interface port can be located in a corner of the top side adjacent the first and second sides. Alternately, the interface unit may be coupled to an interface port of the media processing unit (any imaging device, all forms hereby encompassed by the term printer) located at any portion of the printer capable of providing the desirable orientation flexibility of the present concept. The interface port can further comprise a communication interface for linking a central processing unit of the paper processing device with the interface unit. In one configuration, the device can further comprise a media input tray having an elongate footprint and a media drawer opening to a narrow side of the media input tray for use with the interface unit in the first position. In another configuration, the device can further comprise a media input tray having an elongate footprint and a media drawer opening to a wide side of the media input tray for use with the interface unit in the second position. A media size sensor can be supported by the housing, the media size sensor adapted to sense a media size of media supported in a media tray attached to the housing.

In accordance with another aspect, a media processing device kit comprises a main media processing unit having a housing with an elongate footprint, the housing having a relatively narrow first side adjacent a relatively wide second side, the housing including an interface port located adjacent the first and second sides, an interface unit adapted to be received in the interface port in one of at least two orientations, a first orientation being aligned with the first side of the housing and a second orientation being aligned with a second side of the housing, whereby when the interface unit is received in the interface port in the first orientation, the first side of the housing is the front of the paper processing device, and whereby when the interface unit is received in the interface port in the second orientation, the second side of the housing is the front of the paper processing device, a first media tray having an elongate footprint and a media drawer opening to a narrow side of the media input tray for use with the interface unit in the first position, and a second media input tray having an elongate footprint and a media drawer opening to a wide side of the media input tray for use with the interface unit in the second position.

The interface unit can include at least one of a display or a user input device. The display can be a touch screen and be the primary user input device. The housing can include a top side adjacent the first and second sides, and wherein the interface port is located on the top side of the housing. The interface port can be located in a corner of the top side adjacent the first and second sides. The interface port can further include a communication interface for linking a central processing unit of the paper processing device with the interface unit. The unit can include a media size sensor supported by the housing, the media size sensor adapted to sense a media size of media supported in a media tray attached to the housing. The kit can include a finisher unit.

In accordance with another aspect, a method of assembling a media processing device comprises selecting one of a first or second side of a main media processing unit having an elongate footprint, aligning the media processing device with the selected side facing a desired direction, the selected side being the front of the media processing device, attaching an interface unit to an interface port of the media processing unit such that the interface unit faces the selected side, selecting a media input tray having an elongate footprint and a media drawer opening to a side corresponding to the selected side of the main media processing unit, and coupling the media input tray to the main media processing unit.

DETAILED DESCRIPTION

The present disclosure sets forth a module printer wherein the printer can be configured to address user orientation preference or requirements by attaching or positioning primary subsystems, such as the user control panel, for example, a touch screen display, etc., to the surface desired as the front of the device. A control panel can be minimalist, as simple as a few buttons and small text display. The trend is to more friendly and functional control interfaces such as larger touch screens which may be used alone or in combination with physical buttons. The present concept accommodates desired configurations by allowing different panels to be used, as appropriate to the feature set and price point of the end product. Media input tray assemblies can then be selected to face the front of the device. Orientation of media input access, such as with a slide out paper tray, is defined by the tray housing structure and the direction of tray insertion and withdrawal from either a narrow or wide printer side. Tray assemblies or modules configured for specific printer front orientation can be complementary to internal paper path flow regardless of the direction the tray faces. Other significant functions or systems may further be involved in establishing a preferred front surface, for example a scan or copy feed module.

Figure 1:
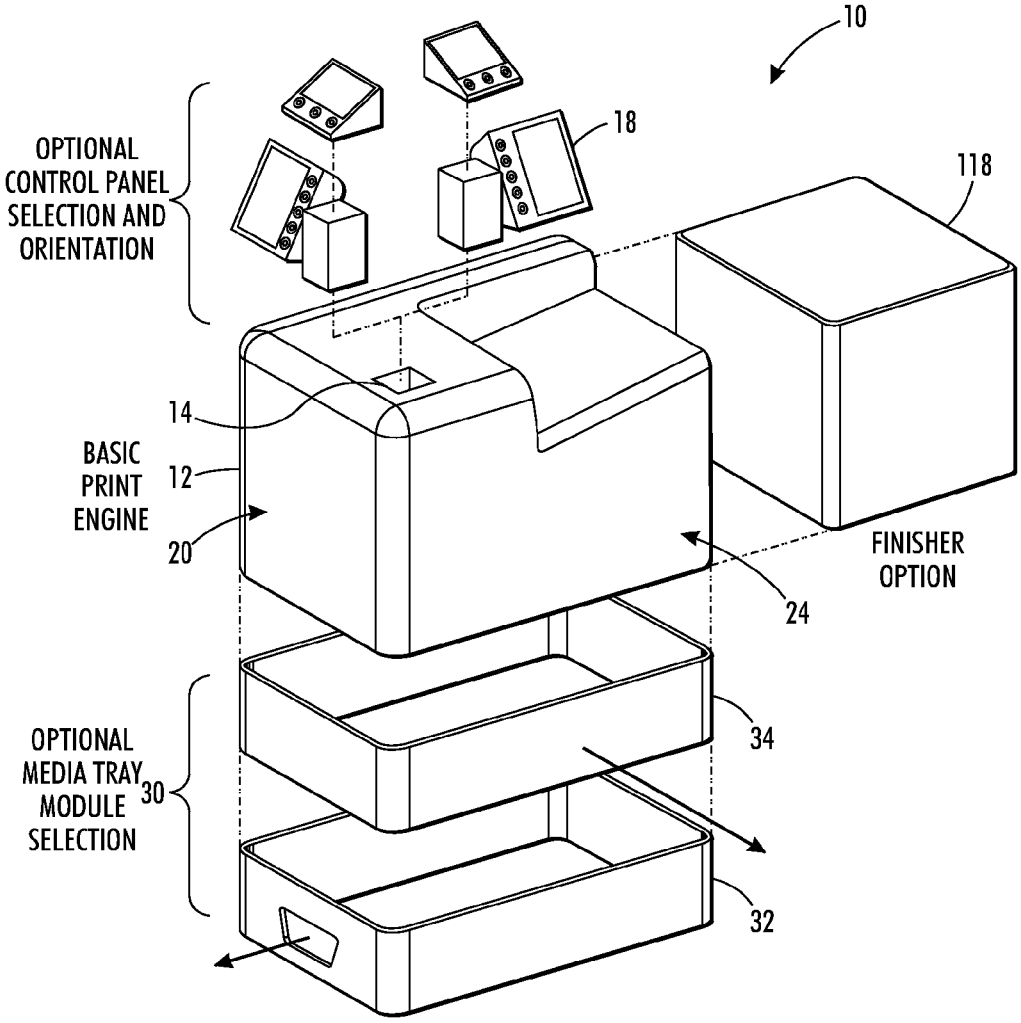
FIG. 1 is an exploded perspective view of an exemplary media processing unit in accordance with the present disclosure.

One exemplary embodiment of the disclosure is illustrated in FIG. 1. A printing unit, generally identified by reference numeral 10, is illustrated that facilitates allowing one platform, basic print engine 12, to be configured for different orientations (e.g., N-S and/or E-W). The print engine unit 12 incorporates a control panel mount 14 in the frame and/or enclosure nearer a corner location that accepts a "plug-in" panel 18 (multiple panel configurations shown) with orientation toward either the end 20 (narrow) or side 24 (wide). The panel 18 can be a minimalist panel configuration that is either rotationally adjustable or capable of being fixed in either orientation. Alternatively, a more comprehensive control panel, for example, a touch screen which may include buttons in addition to a display, can be mounted facing the narrow end or oriented around to face the wide side and then flipped back to front. Other screen configurations can also be accommodated such as one with a rotation base and other appropriate or beneficial position/orientation articulations or dedicated units that will face one way or the other. Attachment of the control panel 18 can include internal or external cable couplings and a snap-in-place or hardware secured mount interface, for example.

An optional media tray module 30 is compatible with E-W or N-S printer configurations based on how it is accessed, rather than the direction the media travels relative to the printer aspect ratio. Exemplary media tray modules include a drawer that pulls out from the short side (end) for a N-S print engine placement (e.g., N-S tray 32) or a long side (wide) of an E-W print engine placement (e.g., E-W tray 34). Media tray internals can include size and positioning guides that can be dedicated to specific media or adjustable for a range of media sizes. The internal guides can be essentially the same in either drawer and oriented so that media is picked and transported along the print engine media path. The drawer frame/housing orientation in addition to the aesthetic treatment and user interface of the drawer, such as a pull handle, differentiates the two configurations and defines them as being an E-W or N-S tray. In either case the tray withdraws to the machine front.

There are multiple ways an E-W or N-S Media (paper) tray option can be accommodated. One print engine implementation is to eliminate any portion of the paper tray frame or housing from the engine and to make the entire tray module a separate unit. Putting the pick mechanism and size sensors in the tray creates an integrated module that more easily allows use of multiple trays, stacked for simultaneous media sizes/types or higher capacity. Alternatively, some tray functionality can be integrated in the printer. The print engine-tray module coupling can be as simple as interface features that secure the stacked units against sliding or tipping so that coupling hardware can be eliminated or employed as desired, such as if the assembly is to be handled as a unit. Trays can have connections to the engine for media size sensing and pick mechanism operation. Such features and the various types and methods of implementation are well known.

It will be appreciated that FIG. 1 illustrates subsystem examples that can be selected to configure an imaging product. The wide range of subsystems influence user interface to the product. Accordingly, any possible combination of such subsystem option, configured to address the issue of optimal orientation, are therefore encompassed by the present disclosure.

Figure 2:
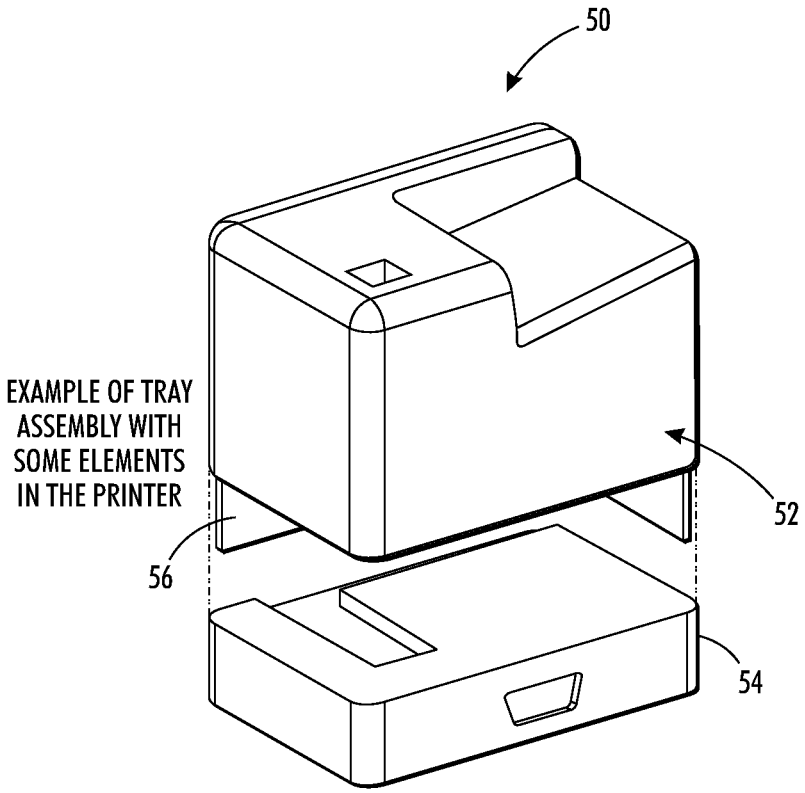
FIG. 2 is a perspective view of another exemplary media processing unit in accordance with the present disclosure.

Another print engine implementation might include one or more portions of the drawer enclosure surround such that some features, such as media size sensing capability, can be incorporated as part of the engine rather than the tray. This would be an implementation where additional tray stacking is not contemplated or where a smaller default tray has reduced capacity, for example. A printing device having such features is illustrated generally by reference numeral 50 in FIG. 2 and includes, among other features, a main media processing unit 52 and a basic media input tray 54 wherein a portion of the drawer enclosure 56 is included as part of a housing 58 of the processing unit 52.

Figure 3A:
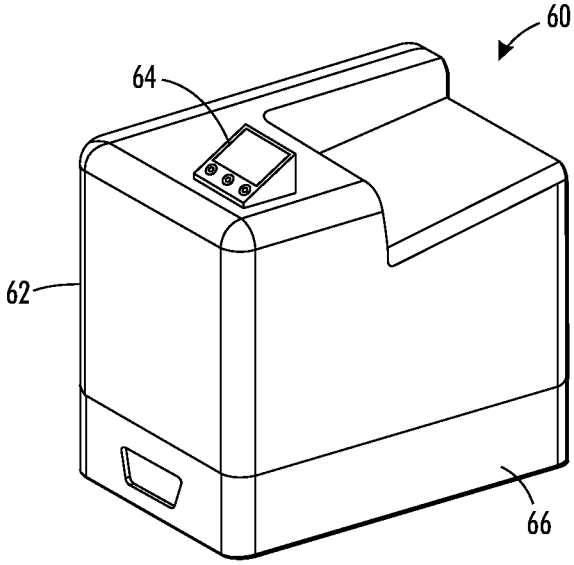
FIGS. 3A-3B illustrate an exemplary media processing unit in first and second configurations.
Figure 3B:
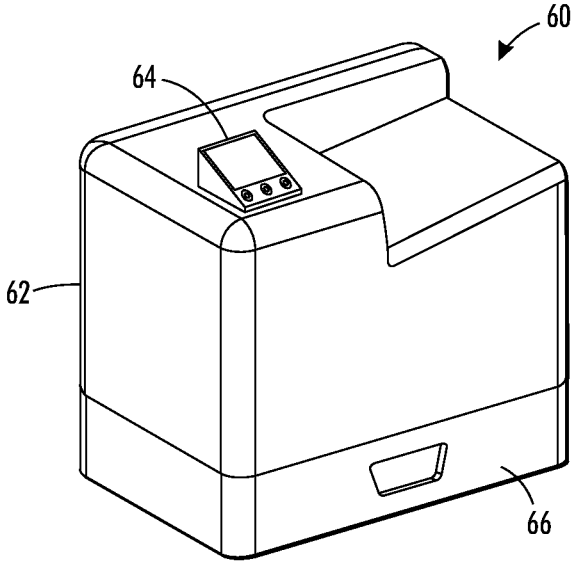

Turning to FIGS. 3A and 3B, an exemplary media processing device is illustrated and identified generally by reference numeral 60. The processing device includes a media processing unit 62 having an elongate footprint (e.g., a rectangular footprint). In FIG. 3A, an interface unit 64 is supported in an interface port of the processing unit 62 and faces a narrow end of the processing unit. A media tray 66 is provided having an access or loading door that opens to the narrow end such that both the interface and the media tray can be accessed from the narrow end of the device. In this configuration, the device can be placed on a work surface with the paper path being N-S.

In FIG. 3B, the same processing device 60 is illustrated with the interface unit oriented towards the wide side of the media processing unit 62, and a media input tray having an access door opening to the wide side is provided. Accordingly, it will be appreciated that in this configuration, the device 60 can be placed on a work surface with the paper path being E-W. Any unit with high capacity media input trays and/or finishing unit may be configured with a floor mount structure.

Figure 4A:
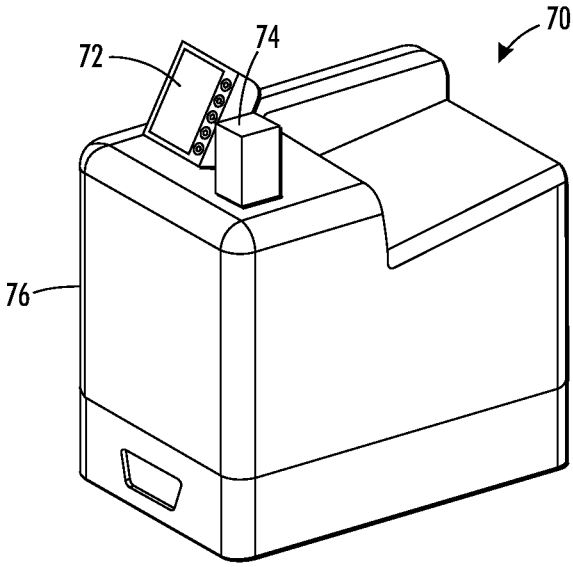
FIGS. 4A-4B illustrate another exemplary media processing unit in first and second configurations.
Figure 4B:
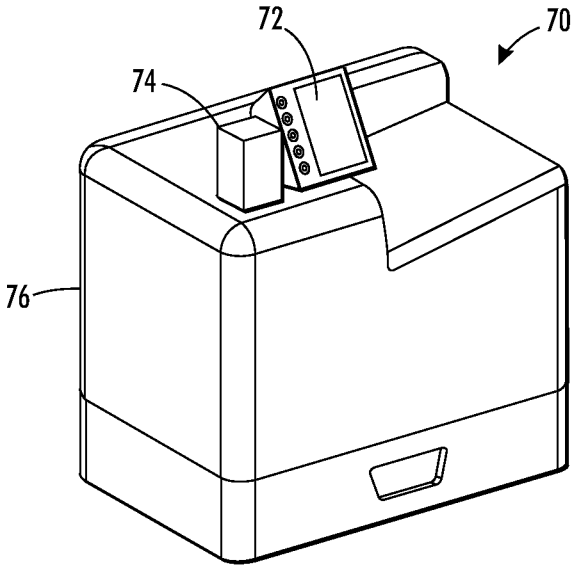

FIGS. 4A and 4B illustrate another exemplary media processing device 70 in first and second configurations. The device 70 is identical to the device 60 with the exception of the user interface and media tray. In this embodiment, a user interface 72 is supported by a pivoting support arm 74 that is received in an interface port of a main media processing unit 76.

Figure 5:
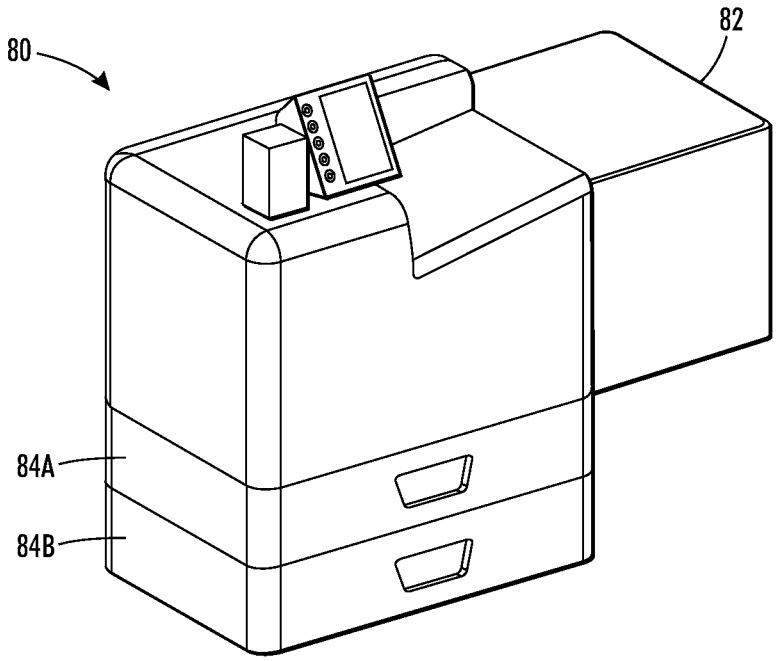
FIG. 5 illustrates the media processing unit of FIG. 4B configured with an optional finisher unit and stacked media input trays.

Turning to FIG. 5, another media processing device 80 is illustrated. In this embodiment, the media processing device 80 is identical to media processing device 70 of FIG. 4B. The media processing device 82 also includes an optional finishing unit 80 for post-processing media (e.g., collating, stapling, etc.), and a pair of stacked media input trays 84A and 84B with wide side opening access doors.

Figure 6:
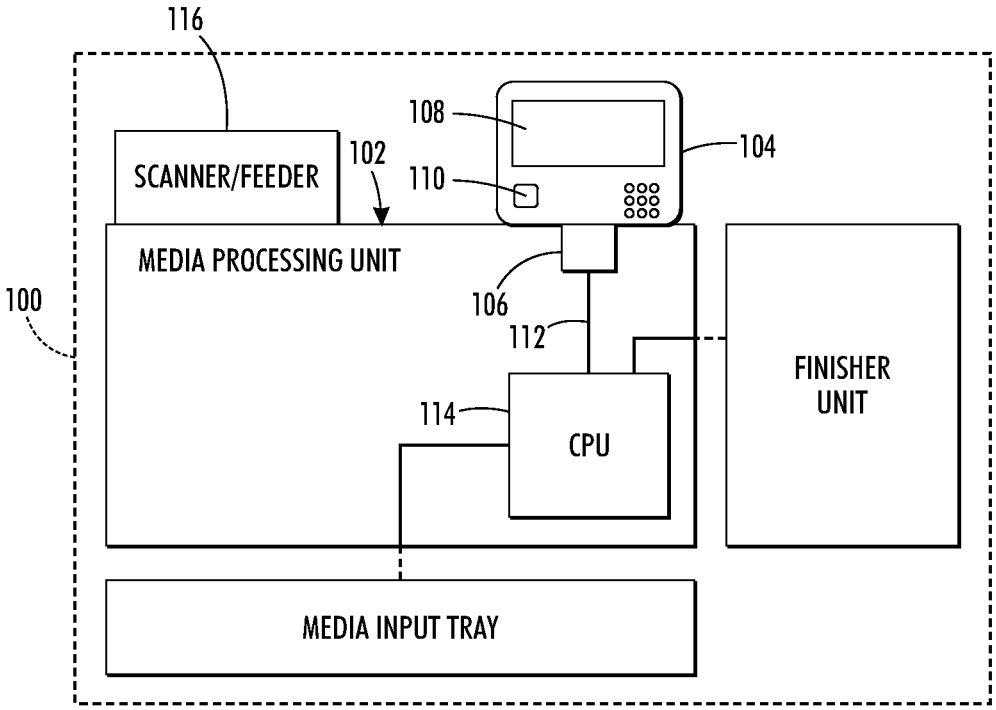
FIG. 6 is a block diagram of an exemplary media processing unit.

Referring now to FIG. 6, a block diagram of an exemplary media processing device 100 in accordance with the present disclosure is illustrated. The device 100 generally includes a main media processing unit 102 and an interface unit 104 received in an interface port 106. The interface unit 104 includes a display 108 and user input device 110 (e.g., buttons). A communication interface 112 links the interface unit 104 with a central processing unit 114 of the media processing unit. A scanner/feeder unit 116, a finisher unit 118 and a media input tray 120 are connected to the media processing unit 102. Both the media tray 120 and the finisher unit are also in communication with the CPU 114 for controlling aspects of their operation.

It will be appreciated that aspects of the flexible printing product configuration concept set forth herein are applicable regardless of the aspect ratio of the footprint or significant portions of the product modules or enclosure. The paper path direction and consideration for various modules and functions, such as maintenance/service access, image input terminals, media input trays and output devices or finishers, can be the definitive driver for product orientation and the benefit of choosing which surface best serves as the front. Accordingly, an end user is free to implement whichever orientation of the device is most desirable, and the device is adaptable for the future should a different orientation be desired.

The printing product of this concept, which can be any printing device, such as a printer, all-in-one, FAX machine or MFP, is thus a flexible print engine architecture allowing the customer to define the desired installation/placement orientation which further defines the product configuration. A narrow front is often preferred when desk or table frontage length is needed for purposes in addition to the printer. In this case, printed output can easily be at the front or back. A wide front with printed output toward the side is a necessary practicality when finishers, such as sorters, are desired. In addition, the concept is applicable to any and all print/imaging technologies, for example, solid ink (phase change), ink jet, LED and/or laser.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A media processing device comprising:

a main media processing unit having a housing with an elongate footprint, the housing having a relatively narrow first side adjacent a relatively wide second side, the housing including an interface port located adjacent the first and second sides and a portion of a drawer enclosure configured to cooperate with an associated media tray, the portion of the drawer enclosure including a media size sensor adapted to sense a media size of media supported in the associated media tray when attached to the housing;

and an interface unit adapted to be received in the interface port in at least two orientations, a first orientation being aligned with the first side of the housing and a second orientation being aligned with a second side of the housing;

whereby when the interface unit is received in the interface port in the first orientation, the first side of the housing is the front of the paper processing device, and whereby when the interface unit is received in the interface port in the second orientation, the second side of the housing is the front of the paper processing device;

the interface unit including a display, the display directed towards the first side of the housing when the interface unit is in the first orientation, and the display directed towards the second side of housing when the interface unit is in the second orientation.

2. A media processing device as set forth in claim 1, wherein the interface unit includes a user input device.

3. A media processing device as set forth in claim 1, wherein the housing includes a top side adjacent the first and second sides, and wherein the interface port is located on the top side of the housing.

4. A media processing device as set forth in claim 3, wherein the interface port is located in a corner of the top side adjacent the first and second sides.

5. A media processing device as set forth in claim 1, wherein the interface port further comprises a communication interface for linking a central processing unit of the paper processing device with the interface unit.

6. A media processing device as set forth in claim 1, further comprising a media input tray having an elongate footprint and a media drawer opening to a narrow side of the media input tray for use with the interface unit in the first position.

7. A media processing device as set forth in claim 1, further comprising a media input tray having an elongate footprint and a media drawer opening to a wide side of the media input tray for use with the interface unit in the second position.

8. A media processing device kit comprising:

a main media processing unit having a housing with an elongate footprint, the housing having a relatively narrow first side adjacent a relatively wide second side, the housing including an interface port located adjacent the first and second sides;

an interface unit adapted to be non-rotatably received in the interface port in two orientations, a first orientation being aligned with the first side of the housing and a second orientation being aligned with a second side of the housing, whereby when the interface unit is received in the interface port in the first orientation, the first side of the housing is the front of the paper processing device, and whereby when the interface unit is received in the interface port in the second orientation, the second side of the housing is the front of the paper processing device;

a first media tray having an elongate footprint and a media drawer opening to a narrow side of the media input tray for use with the interface unit in the first position, and a second media input tray having an elongate footprint and a media drawer opening to a wide side of the media input tray for use with the interface unit in the second position.

9. A media processing device kit as set forth in claim 8, wherein the interface unit includes at least one of a display or a user input device, and wherein the at least one of a display or user input device are directed towards the first side of the housing when the interface unit is in the first orientation, and the at least one of a display or user input device are directed towards the second side of housing when the interface unit is in the second orientation.

10. A media processing device kit as set forth in claim 8, wherein the housing includes a top side adjacent the first and second sides, and wherein the interface port is located on the top side of the housing.

11. A media processing device kit as set forth in claim 10, wherein the interface port is located in a corner of the top side adjacent the first and second sides.

12. A media processing device kit as set forth in claim 8, wherein the interface port further comprises a communication interface for linking a central processing unit of the paper processing device with the interface unit.

13. A media processing device kit as set forth in claim 8, further comprising a media size sensor supported by the housing, the media size sensor adapted to sense a media size of media supported in a media tray attached to the housing.

14. A media processing device kit as set forth in claim 8, further comprising a finisher unit.

15. A method of assembling a media processing device comprising:

selecting one of a first or second side of a main media processing unit having an elongate footprint;

aligning the media processing device with the selected side facing a desired direction, the selected side being the front of the media processing device;

attaching an interface unit to an interface port of the media processing unit such that the interface unit faces the selected side, the interface unit adapted to be non-rotatably received in the interface port in two orientations, a first orientation being aligned with the first side of the main media processing unit and a second orientation being aligned with the second side of the media processing unit;

selecting a media input tray having an elongate footprint and a media drawer opening to a side corresponding to the selected side of the main media processing unit; and coupling the media input tray to the main media processing unit.

* * * * *